United States Patent [19]

Scott

[11] 4,089,651

[45] May 16, 1978

[54] PYROPHOSPHATE-ZINC CORROSION INHIBITOR

[75] Inventor: James E. Scott, LaHabra, Calif.

[73] Assignee: Nalco Chemical Company, Oak Brook, Ill.

[21] Appl. No.: 711,756

[22] Filed: Aug. 4, 1976

[51] Int. Cl.[2] ..... C23F 11/18; C23F 11/16

[52] U.S. Cl. ..... 21/2.7 R; 21/2.7 A; 106/14.12; 252/8.55 E; 252/68; 252/387; 252/389 A

[58] Field of Search ..... 252/389 A, 387, 8.55 E, 252/147, 175, 68; 21/2.7 R, 2.7 A, 2.5 R, 2.5 A; 106/14

[56] References Cited

U.S. PATENT DOCUMENTS

| | | | |
|---|---|---|---|
| 3,445,395 | 5/1969 | Boehmer | 252/389 A |
| 3,510,436 | 5/1970 | Silverstein et al. | 252/389 A |
| 3,580,855 | 5/1971 | Mickus | 252/389 A |
| 3,668,132 | 6/1972 | Finder | 252/387 |
| 3,669,616 | 6/1972 | Murray et al. | 252/387 |
| 3,887,488 | 6/1975 | Scott et al. | 252/389 A |

*Primary Examiner*—Benjamin R. Padgett
*Assistant Examiner*—Irwin Gluck
*Attorney, Agent, or Firm*—John G. Premo; Robert A. Miller; Barry W. Sufrin

[57] ABSTRACT

A method for inhibiting metal corrosion in once-through water systems entailing the use of a pyrophosphate-zinc composition.

5 Claims, No Drawings

PYROPHOSPHATE-ZINC CORROSION INHIBITOR

BACKGROUND

The prevention of corrosion in once-through water systems has long been of great concern to both the private and the public sectors. These once-through systems include municipal water systems and industrial once-through water cooling systems.

In the past, in muncipal water systems, corrosion inhibition has been directed toward the protection of mild steel, galvanized steel and cast iron found in these systems. Now that copper piping and fittings are increasingly being used in homes and at other points in the municipal water system, it becomes important to deal with potential copper corrosion problems. This is an especially important concern in view of environmental regulations shortly to come into effect.

According to current municipal water testing regulations, the metal ion content of municipal water systems is measured at points short of the delivery location (i.e. at fire hydrants). Since copper piping or fittings are generally not present in the system prior to or at these points, present steel and iron corrosion treatments suffice to prevent corrosion. However, under new regulations which will soon come into effect, municipal water testing will be carried out at the delivery site (i.e. the home tap). When testing is carried out at this point, undesirably higher copper levels will be encountered unless the water is pretreated with a copper corrosion inhibitor such as the treatment described herein. Thus, the present invention becomes especially important.

In addition to its use in municipal water systems, copper* is found in industrial water systems at such points as the cast copper fittings into which black iron pipings may be fitted. At these points, corrosion of the copper fittings may be a problem. In addition, there is a likelihood of corrosion due to galvanic coupling at the point of interconnection.

*Copper as used herein also includes alloys of copper such as brass and admiralty metal.

Typical corrosion inhibitors employed in once-through water systems such as those described above have included sodium hexametaphosphate and zinc salt-polyphosphate combinations. These treatments have been used to prevent steel and iron corrosion, but they have not been used to prevent copper corrosion. Indeed, the most common treatment — sodium hexametaphosphate — will not prevent copper corrosion and may, in some cases, increase the corrosion rate.

I have now discovered a particular polyphosphate composition which offers important advantages over polyphosphate-zinc compositions generally as a corrosion inhibitor and which has outstanding ability to prevent or reduce copper and mild steel corrosion rates.

OBJECTS

It is an object of the present invention to provide to the art a practical means for preventing or reducing copper corrosion in once-through water systems. It is a further object of the present invention to provide a method of inhibiting copper corrosion which is especially well adapted to the treatment of municipal water systems.

Another object of the present invention is to teach a method for reducing galvanic corrosion.

Yet another object of the present invention is to provide a method for reducing corrosion in mild steel.

Other objects will appear hereinafter.

THE INVENTION

The invention entails a method for inhibiting metal corrosion in once-through water systems by maintaining in the water used in these systems a specified level of pyrophosphate-zinc composition. The level of pyrophosphate which should be maintained should range from 0.1–20 ppm by weight; the level of zinc maintained will range from 0.01–10 ppm by weight. In municipal water systems, the pyrophosphate concentration should not exceed 10 and most preferably will lie within the range 0.1–0.9 ppm. In such municipal systems, the zinc concentration (measured as zinc) should not exceed 5 ppm and most preferably will lie within the range 0.04–0.3 ppm.

When I refer to pyrophosphate, I intend to include potassium pyrophosphate, sodium pyrophosphate and ammonium pyrophosphate.

While the zinc concentrations discussed above refer to zinc metal, the zinc will be introduced in the form of a zinc salt. Typical zinc salts useful in the present application include zinc sulfate, zinc chloride and zinc nitrate. In practice, of course, any form of a soluble zinc salt will suffice.

The dosages described above should be continuously maintained in the once-through water. However, in some applications, it will be acceptable to run the systems without treatment for recurring limited periods. Also, when treating new systems, it is best to use an initial high dose followed by the lower continuous dose described above. By high initial dose, I mean 2 or 3 times the lower continuous dosage. The high initial dose should be maintained for at least 1 hour and preferably will be continued for a period of 12–24 hours.

EXAMPLES

EXAMPLE 1

The test described in this example was carried out on a blast furnace once-through cooling water system. A test unit designed to measure corrosion was installed on the blast furnace in such a way that blast furnace discharge water could be circulated past test coupons.

The corrosiveness to copper of the blast furnace discharge water before treatment was compared to its corrosiveness after treatment. Dosages were within the ranges of Claim 1. The results obtained indicated that the rate of copper corrosion was reduced by 84%.

In addition to the coupon testing, galvanic corrosion was monitored by running the discharge water through interconnected copper and mild steel sample tubes. Although there was some evidence of galvanic corrosion between the copper and mild steel for both treated and untreated discharge water, the tube section from the treated system contained lesser deposits and showed less corrosion than did the tube from the untreated system.

In another test run in which galvanic corrosion rates were evaluated, direct iron-copper couples were prepared and incorporated in the test unit. In the first run, galvanic attack was noted on the untreated tubes; no galvanic attack was found on the treated tubes. In a second run, slight galvanic attack was found on both tubes. It is believed that longer test periods would conclusively demonstrate significant reduction of galvanic attack in the treated system.

EXAMPLE 2

A test may be carried out to show synergism between the pyrophosphate and the zinc. In this example, a copper test sample may be subjected to a once-through water system which causes corrosion of 10 mils per year. If, now, a pyrophosphate dosage which would reduce the corrosion to 5 mils per year is used in combination with a zinc treatment which would also reduce the corrosion to 5 mils per year, it would be expected that the pyrophosphate plus the zinc would result in corrosion of 2 mils per year. It will be found however, that the zinc-pyrophosphate combination will result in a corrosion rate of only 1 mil per year.

EXAMPLE 3

This test can be carried out to demonstrate an advantage of pyrophosphate-zinc over the traditional orthophosphate-zinc treatment: the orthophosphate treatment is useful only in fairly soft waters which are not severely alkaline.

Thus, if once-through waters are adjusted to pH 8.0 or higher and treated with orthophosphates, it will be found that calcium phosphate and iron phosphate precipitate out. In actual industrial once-through systems, these precipitates will interfere with water flow.

If water adjusted to pH 8.0 or higher is treated with pyrophosphate-zinc, neither calcium or iron phosphate will form. Hence, the pyrophosphate treatment is useful at a far wider ph range than the orthophosphate.

I claim:

1. A method for inhibiting metal corrosion in once-through water systems comprising maintaining a level of 0.1–20 ppm by weight of pyrophosphate and 0.01–10 ppm by weight of zinc in the water passing through the system, said once-through systems being characterized as being at least partially composed of copper alloys.

2. The method of claim 1 wherein the pyrophosphate is potassium pyrophosphate.

3. The method of claim 1 wherein the pyrophosphate is sodium pyrophosphate.

4. The method of claim 1 wherein the pyrophosphate is present at a level of 0.1–0.9 ppm and the zinc is present at a level of 0.04–0.3 ppm.

5. The method of claim 1 wherein the pyrophosphate is ammonium pyrophosphate.

* * * * *